US012396603B2

(12) United States Patent
Ning

(10) Patent No.: US 12,396,603 B2
(45) Date of Patent: Aug. 26, 2025

(54) DEVICE STRUCTURE FOR AUTOMATICALLY OPENING AND CLOSING WASTEWATER TANK VALVE OF CLEANING MACHINE

(71) Applicant: GuangDong Well Technology Co., Ltd, Guangdong (CN)

(72) Inventor: Jianqiang Ning, Guangdong (CN)

(73) Assignee: GuangDong Well Technology Co., Ltd, Huizhou (CN)

( * ) Notice: Subject to any disclaimer, the term of this patent is extended or adjusted under 35 U.S.C. 154(b) by 386 days.

(21) Appl. No.: 18/112,688

(22) Filed: Feb. 22, 2023

(65) Prior Publication Data

US 2024/0008698 A1 Jan. 11, 2024

(30) Foreign Application Priority Data

Jul. 11, 2022 (CN) ..... 202210808195.7

(51) Int. Cl.
*A47L 7/00* (2006.01)
*A47L 9/28* (2006.01)
*A47L 9/32* (2006.01)

(52) U.S. Cl.
CPC ..... *A47L 7/0028* (2013.01); *A47L 9/2836* (2013.01); *A47L 9/322* (2013.01)

(58) Field of Classification Search
CPC ..... A47L 7/0028; A47L 9/2836; A47L 9/322
See application file for complete search history.

(56) References Cited

U.S. PATENT DOCUMENTS 4,536,914 A * 8/1985 Levine ..... A47L 7/0028 15/353
6,687,952 B1 * 2/2004 Mohan, Jr. ..... A47L 7/0028 15/419
8,429,788 B1 * 4/2013 Lovelady ..... A47L 7/0009 15/353
2005/0022333 A1 * 2/2005 McDowell ..... A47L 11/4088 15/320
2006/0150364 A1 * 7/2006 Morgan ..... A47L 7/0042 15/320

(Continued)

FOREIGN PATENT DOCUMENTS

CN 2856612 Y * 1/2007
CN 203042128 U * 7/2013 ..... A47L 1/05
CN 204379212 U * 6/2015

(Continued)

*Primary Examiner* — Marc Carlson

(57) ABSTRACT

Disclosed is a device structure for automatically opening and closing a wastewater tank valve of a cleaning machine, including a cleaning machine body which is provided with a water-air separation chamber at a top and is detachably mounted with a wastewater tank at a bottom, the water-air separation chamber is provided with one end connected to a water drawing pipe and the other end connected to a main motor having a suction function, and provided with a drain port at a bottom end, the wastewater tank is provided with a wastewater tank inlet at a top end, and the drain port is communicated with the wastewater tank inlet. The wastewater tank inlet is cooperated with a water closing valve which is connected to a drive device, the drive device is capable of driving the water closing valve to open and close the wastewater tank inlet.

19 Claims, 4 Drawing Sheets

(56) References Cited

U.S. PATENT DOCUMENTS

2017/0280954 A1* 10/2017 Romero ..... A47L 5/18

FOREIGN PATENT DOCUMENTS

| | | | | | |
|---|---|---|---|---|---|
| CN | 205181223 | U | * | 4/2016 | |
| CN | 207520094 | U | * | 6/2018 | |
| CN | 108953622 | A | * | 12/2018 | ..... B64B 1/00 |
| CN | 216876228 | U | * | 7/2022 | ..... A47L 11/24 |
| FR | 3004328 | A1 | * | 10/2014 | ..... A47L 1/05 |

* cited by examiner

DEVICE STRUCTURE FOR AUTOMATICALLY OPENING AND CLOSING WASTEWATER TANK VALVE OF CLEANING MACHINE

CROSS REFERENCE TO RELATED APPLICATIONS

The present application claims the benefit of Chinese Patent Application No. 202210808195.7 filed on Jul. 11, 2022, the contents of which are incorporated herein by reference in their entirety.

TECHNICAL FIELD

The present disclosure relates to the technical field of cleaning machines, and in particular, to a device structure for automatically opening and closing a wastewater tank valve of a cleaning machine.

BACKGROUND

Devices, such as handheld fabric cleaning machines (or carpet washing machines), usually use a large-power suction motor to suck wastewater in a fabric (or carpet) obtained after washing the fabric (or carpet) by a rolling brush into a water-air separation chamber through a pipeline. After water-air separation, the wastewater enters a wastewater tank, and separated air is discharged out of the handheld fabric cleaning machines by means of a main motor (i.e., a suction motor).

Currently, in all the handheld fabric cleaning machines (or carpet washing machines) on the market, after the wastewater obtained by the water-air separation enters the wastewater tank, there is no special valve (in a case where the main motor does not operate) to close the wastewater tank. In this case, the wastewater tank is communicated with the water-air separation chamber. Therefore, the following defects may occur when the main motor does not operate:

1. Because of the convenience and flexibility of a handheld fabric cleaning machine (or carpet washing machine), a user does not always keep the machine in a horizontal position state when holding the machine in hand. Therefore, the machine will incline forwards or backwards, or incline leftwards or rightwards.

2. After the user finishes cleaning with the handheld fabric cleaning machine (or carpet washing machine), the machine may fall over when the user places the machine.

When the above two cases occur, the wastewater stored in the wastewater tank may flow back through a wastewater tank inlet, enter the water-air separation chamber, the motor or the pipeline, and even enter the handheld fabric cleaning machine body, and finally flow out of different parts of the handheld fabric cleaning machine body, thereby causing secondary pollution.

SUMMARY

An objective of the present disclosure is to provide a device structure for automatically opening and closing a wastewater tank valve of a cleaning machine, to solve the technical problem set forth in the background art that when the above two defects occur, the wastewater stored in the wastewater tank may flow back through the wastewater tank inlet, enter the water-air separation chamber, the motor or the pipeline, and even enter the handheld fabric cleaning machine body, and finally flow out of different parts of the handheld fabric cleaning machine body, thereby forming the secondary pollution.

To achieve the above objective, the technical solution of the present disclosure provides a device structure for automatically opening and closing a wastewater tank valve of a cleaning machine, including a cleaning machine body. A water-air separation chamber is provided at a top of the cleaning machine body, a wastewater tank is detachably mounted at a bottom of the cleaning machine body, one end of the water-air separation chamber is connected to a water drawing pipe and the other end of the water-air separation chamber is connected to a main motor having a suction function, a drain port is provided at a bottom end of the water-air separation chamber, a wastewater tank inlet is provided at a top end of the wastewater tank, and the drain port is communicated with the wastewater tank inlet. The wastewater tank inlet is cooperated with a water closing valve which is connected to a drive device, the drive device is capable of driving the water closing valve to open and close the wastewater tank inlet, the drive device is connected to a main control board with wires, and the main motor is connected to the main control board with wires.

Further, a rotating shaft extending forwards and backwards is provided in the wastewater tank, the rotating shaft is disposed at a lower right side of the wastewater tank inlet, the rotating shaft is movably connected to one end of a valve support, and the other end of the valve support is connected to the water closing valve; and the drive device is connected to the valve support and is capable of driving the other end of the valve support connected to the water closing valve to swing up and down around the rotating shaft, such that the water closing valve is capable of moving upwards to block the wastewater tank inlet or moving downwards to separate from the wastewater tank inlet.

Further, the drive device includes a drive device body and a torsion spring, the torsion spring is disposed on the rotating shaft and is capable of driving the other end of the valve support connected to the water closing valve to automatically swing up around the rotating shaft, such that the water closing valve is capable of moving upwards to block the wastewater tank inlet; and alternatively, the drive device body is connected to the main control board with wires, and the drive device body is capable of driving the other end of the valve support connected to the water closing valve to swing down, such that the water closing valve is capable of moving downwards to separate from the wastewater tank inlet.

Further, a through hole is further provided in the top end of the wastewater tank, the through hole is disposed at a right side of the wastewater tank inlet and located above the valve support, and a thimble capable of moving up and down is provided in the through hole; and a bottom end of the thimble downwards abuts against the valve support, the thimble is disposed between the water closing valve and the rotating shaft, and the drive device body is disposed above the through hole and is capable of driving the thimble to move downwards.

Further, an arc-shaped portion is provided on the bottom end of the thimble, a face-up arc-shaped surface is provided on a middle of the valve support, which is in sliding fit with the arc-shaped portion.

Further, a width of the arc-shaped portion is greater than an inner diameter of the through hole.

Further, the drive device body includes a micro motor and a transmission connecting rod, the transmission connecting rod is disposed above the thimble, the micro motor is connected to the main control board with wires, the micro motor is capable of driving the transmission connecting rod to move up and down, and the transmission connecting rod is capable of driving the thimble to move downwards.

Further, a tooth row arranged up and down is provided on a side wall of a top end of the transmission connecting rod, an output shaft of the micro motor extends horizontally and is connected to a gear, and the gear is engaged with the tooth row.

Further, the micro motor and the transmission connecting rod are disposed in the cleaning machine body.

Further, the main motor and the main control board are disposed in the cleaning machine body.

In conclusion, with the above technical solutions, the present disclosure has the following beneficial effects: the structural design is reasonable in the present disclosure; the wastewater tank inlet is cooperated with the water closing valve, the water closing valve is connected to the drive device, the drive device can drive the water closing valve to open and close the wastewater tank inlet, the drive device is connected to the main control board with wires, and the main motor is connected to the main control board with wires, such that the main motor and the drive device can cooperate. That is, when the main motor is working, the drive device can drive the water closing valve to open the wastewater tank inlet, such that the wastewater in the water-air separation chamber can enter the wastewater tank; and when the main motor stops working, the drive device can drive the water closing valve to close the wastewater tank inlet to achieve a purpose of water closing. In this way, when the above two defects set forth in the background art occur, the water closing valve can effectively prevent the wastewater stored in the wastewater tank from flowing back through the wastewater tank inlet.

Figure 1:
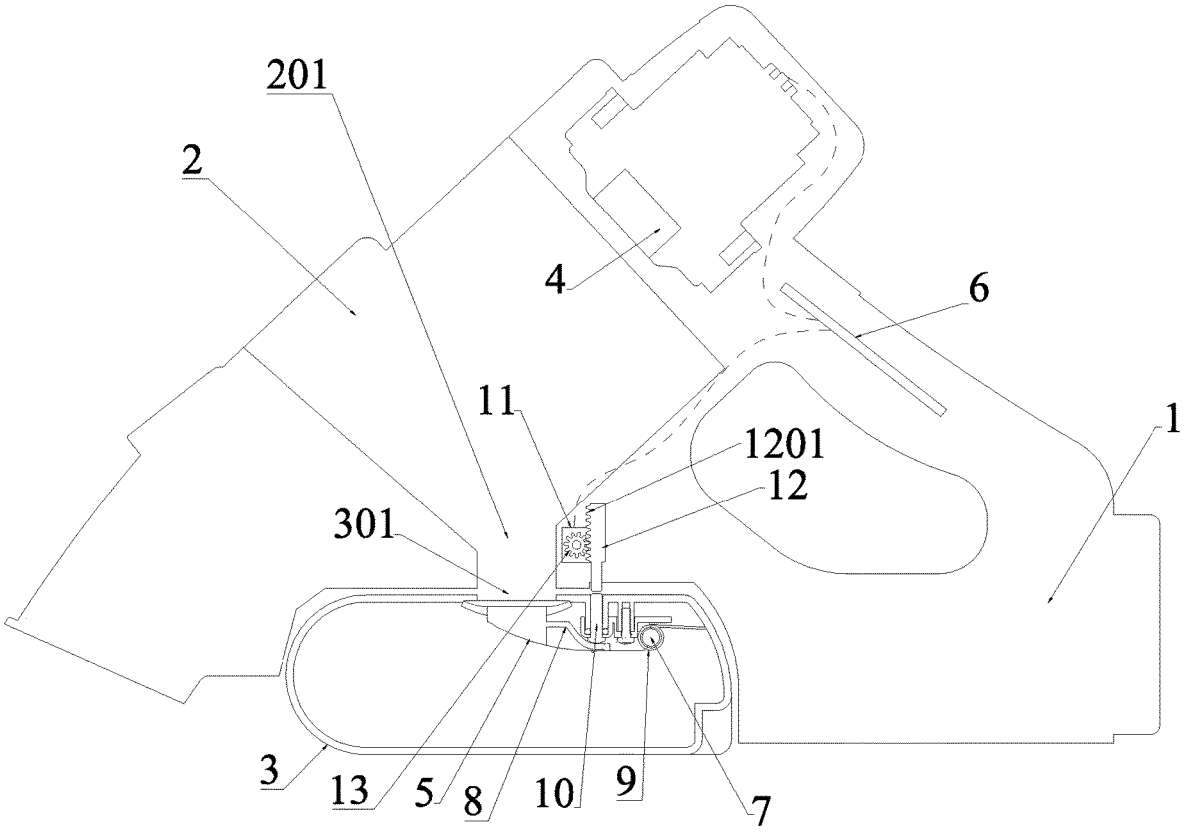
FIG. 1 is a schematic cross-sectional structural diagram of a device structure according to the present disclosure with a water closing valve closed.
Figure 2:
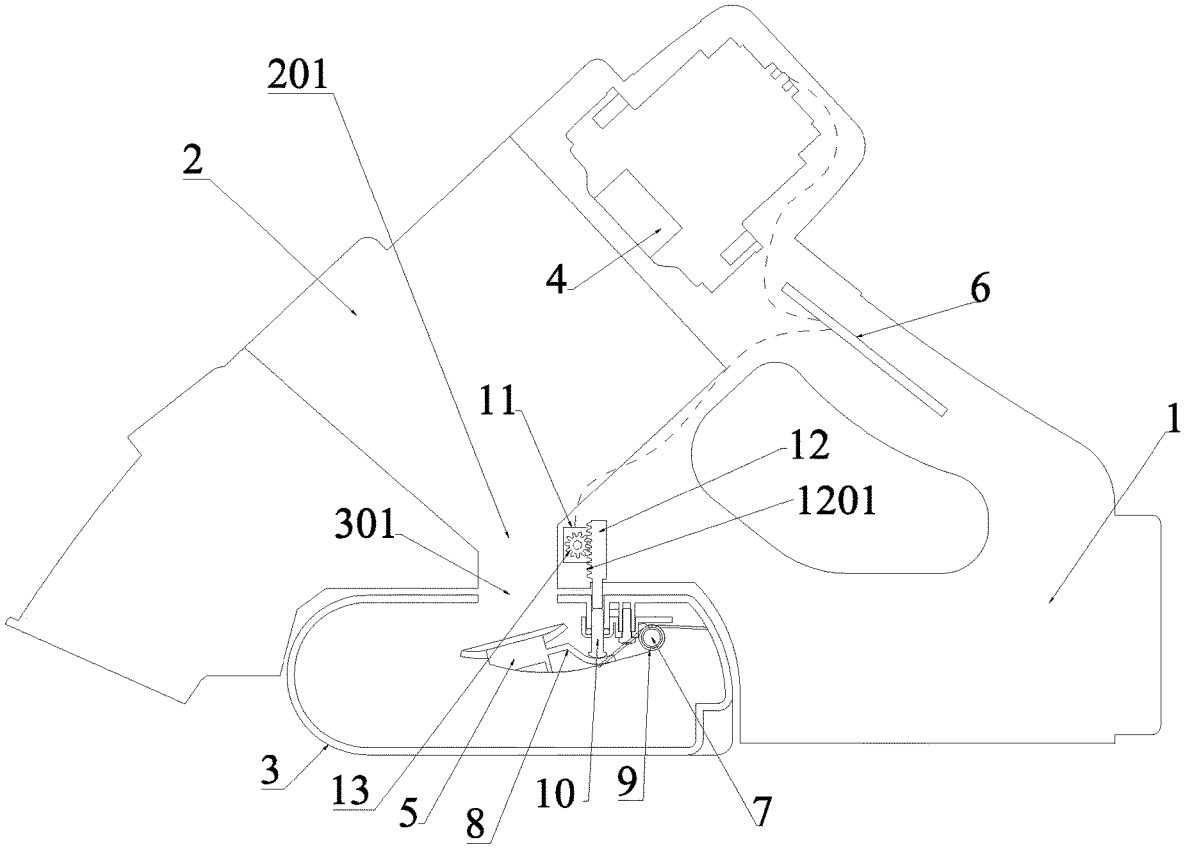
FIG. 2 is a schematic cross-sectional structural diagram of a device structure according to the present disclosure with a water closing valve opened.
Figure 3:
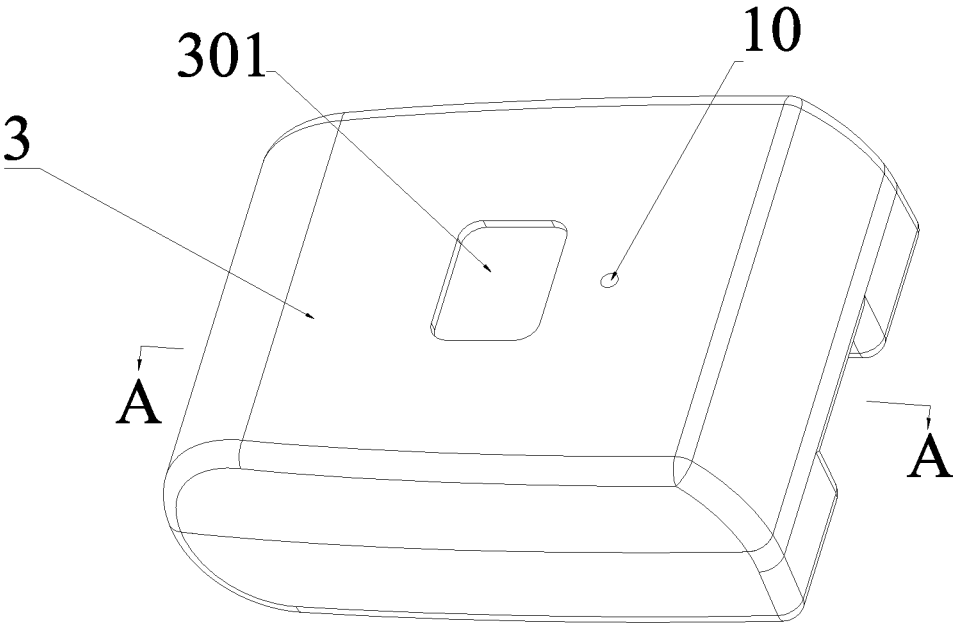
FIG. 3 is a schematic three-dimensional structural diagram of a wastewater tank a device structure according to the present disclosure.
Figure 4:
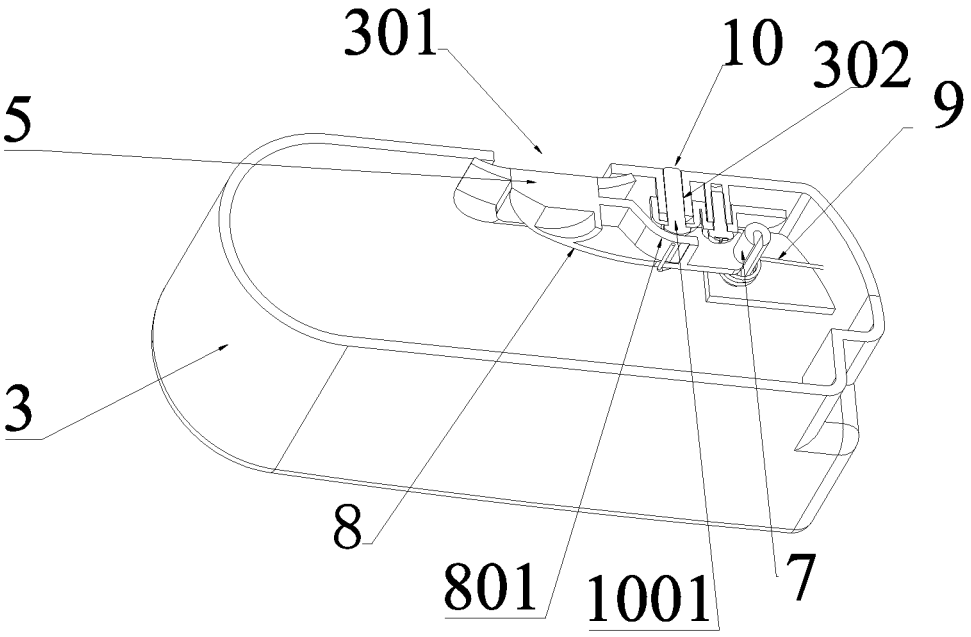
FIG. 4 is a schematic cross-sectional structural diagram obtained after sectioning along a sectioning line A-A in FIG. 3.

Reference Numerals: 1—Cleaning machine body; 2—Water-air separation chamber, 201—Drain port; 3—Wastewater tank, 301—Wastewater tank inlet, 302—Through hole; 4—Main motor, 5—Water closing valve, 6—Main control board, 7—Rotating shaft; 8—Valve support, 801—Arc-shaped surface; 9—Torsion spring; 10—Thimble, 1001—Arc-shaped portion; 11—Micro motor; 12—Transmission connecting rod, 1201—Tooth row; 13—Gear.

DETAILED DESCRIPTION

The technical solutions of the present disclosure will be described below clearly and completely with reference to the drawings in the embodiment of the present disclosure, however, the protection scope of the present disclosure is not limited thereto.

In the present disclosure, for a clearer description, the following explanations are made: an observer faces FIG. 1 to observe, the left side of the observer is defined as left, the right side of the observer is defined as right, the front of the observer is defined as front, the rear of the observer is defined as rear, the upper side of the observer is defined as top, and the lower side of the observer is defined as bottom. It should be pointed out that the orientation or positional relationship indicated by the terms "front", "rear", "left", "right", "middle", "above" and "below" in the text represents the orientation or positional relationship set on the basis of the drawings. These terms are merely intended to facilitate the description of the present disclosure, rather than to indicate or imply that the mentioned structure or components must have a specific orientation or must be constructed in a specific orientation. Therefore, these terms should not be understood as a limitation to the present disclosure. Moreover, the terms "first", "second", "third", and "fourth" are used only for the purpose of clarifying or simplifying the description, and are not intended to indicate or imply relative importance or quantity.

Refer to FIG. 1 to FIG. 4. The present embodiment provides a device structure for automatically opening and closing a wastewater tank valve of a cleaning machine, including a cleaning machine body 1. A water-air separation chamber 2 is provided at a top of the cleaning machine body 1, a wastewater tank 3 is detachably mounted at a bottom of the cleaning machine body 1, one end of the water-air separation chamber 2 is connected to a water drawing pipe (not shown in the drawings) and the other end of the water-air separation chamber 2 is connected to a main motor 4 having a suction function, a drain port 201 is provided at a bottom end of the water-air separation chamber 2, a wastewater tank inlet 301 is provided at a top end of the wastewater tank 3, and the drain port 201 is communicated with the wastewater tank inlet 301; and the wastewater tank inlet 301 is cooperated with a water closing valve 5, the water closing valve 5 is connected to a drive device, the drive device is capable of driving the water closing valve 5 to open and close the wastewater tank inlet 301, the drive device is connected to a main control board 6 with wires, and the main motor 4 is connected to the main control board 6 with wires. Effects: the wastewater tank inlet is cooperated with the water closing valve, the water closing valve is connected to the drive device, the drive device can drive the water closing valve to open and close the wastewater tank inlet, the drive device is connected to the main control board with wires, and the main motor is connected to the main control board with wires, such that the main motor and the drive device can cooperate. That is, when the main motor is working, the drive device can drive the water closing valve to open the wastewater tank inlet, such that the wastewater in the water-air separation chamber can enter the wastewater tank; and when the main motor stops working, the drive device can drive the water closing valve to close the wastewater tank inlet to achieve the purpose of water closing. In this way, when the above two defects set forth in the background art occur, the water closing valve can effectively prevent the wastewater stored in the wastewater tank from flowing back through the wastewater tank inlet. Description: by the limitation "the main motor is working" means that when the user uses the handheld fabric cleaning machine (or carpet washing machine), the main motor having the suction function is powered up. The main motor has the functions of sucking the wastewater into the water-air separation chamber through the water drawing pipe, then separating the wastewater from air in the water-air separation chamber, and extracting the air out of the cleaning machine body. The cleaning machine refers to the handheld fabric cleaning machine or the carpet washing machine. The wastewater tank attached to the cleaning machine body refers to a wastewater tank which is detachable. The user can easily detach the wastewater tank for cleaning when cleaning the wastewater tank.

Specifically, a rotating shaft 7 extending forwards and backwards is provided in the wastewater tank 3, the rotating shaft 7 is disposed at a lower right side of the wastewater tank inlet 301, the rotating shaft 7 is movably connected to one end of a valve support 8, and the other end of the valve support 8 is connected to the water closing valve 5; and the drive device is connected to the valve support 8 and is capable of driving the other end of the valve support 8 connected to the water closing valve 5 to swing up and down around the rotating shaft 7, such that the water closing valve 5 is capable of moving upwards to block the wastewater tank inlet 301 or moving downwards to separate from the wastewater tank inlet 301. Effect: by moving the other end of the valve support around the rotating shaft, the up-down swing trajectory of the water closing valve driven by the valve support is accurate and stable.

Specifically, the drive device includes a drive device body and a torsion spring 9, the torsion spring 9 is disposed on the rotating shaft 7 and is capable of driving the other end of the valve support 8 connected to the water closing valve 5 to automatically swing up around the rotating shaft 7, such that the water closing valve 5 is capable of moving upwards to block the wastewater tank inlet 301; and the drive device body is connected to the main control board 6 with wires and is capable of driving the other end of the valve support 8 connected to the water closing valve 5 to swing down, such that the water closing valve 5 is capable of moving downwards to separate from the wastewater tank inlet 301. Effects: a water closing valve controlled by the torsion spring is provided in the wastewater tank, and this water closing valve is in a normally closed state under the action of the torsion spring, so that when the wastewater tank is disassembled from the cleaning machine body or assembled with the cleaning machine body, the water closing valve is always in a closed state. Two free elastic arms at tail ends of the torsion spring can be connected and cooperated with the valve support and an inner wall of the wastewater tank, respectively, and of course, other structural modes may also be adopted, as long as the torsion spring can drive the other end of the valve support connected to the water closing valve to automatically swing up around the rotating shaft.

Specifically, a through hole 302 is further provided in the top end of the wastewater tank 3, the through hole 302 is disposed at a right side of the wastewater tank inlet 301 and located above the valve support 8, and a thimble 10 capable of moving up and down is provided in the through hole 302; and a bottom end of the thimble 10 downwards abuts against the valve support 8, the thimble 10 is disposed between the water closing valve 5 and the rotating shaft 7, and the drive device body is disposed above the through hole 302 and is capable of driving the thimble 10 to move downwards. Effects: a thimble is provided, with one end is placed on the valve support, so that when the thimble is stressed, the valve support is forced to move downwards, thereby opening the water closing valve, and when the thimble is not stressed, the torsion spring acts on the valve support, and the water closing valve is closed.

Specifically, an arc-shaped portion 1001 is provided on the bottom end of the thimble 10, and a face-up arc-shaped surface 801 is provided on a middle of the valve support 8, which is in sliding fit with the arc-shaped portion 1001. Effects: by means of sliding fit between the arc-shaped portion and the arc-shaped surface, it is convenient for the thimble to eject the valve support downwards.

Specifically, a width of the arc-shaped portion 1001 is greater than an inner diameter of the through hole 302. Effects: such a design can prevent the thimble from moving upwards out of the through hole.

Specifically, the drive device body includes a micro motor 11 and a transmission connecting rod 12, the transmission connecting rod 12 is disposed above the thimble 10, the micro motor 11 is connected to the main control board 6 with wires, the micro motor 11 is capable of driving the transmission connecting rod 12 to move up and down, and the transmission connecting rod 12 is capable of driving the thimble 10 to move downwards. Effects: the wastewater tank is detachable. When the wastewater tank is mounted to the cleaning machine body, the micro motor drives the transmission connecting rod to move. When the transmission connecting rod is stressed to act on the thimble of the wastewater tank, the thimble is stressed to act on the valve support, thereby opening the water closing valve. When the action force of the transmission connecting rod on the thimble disappears, the water closing valve of the wastewater tank is closed under the action of the torsion spring. By the cooperation of the micro motor and the main motor, when the main motor is working, the micro motor operates to drive the transmission connecting rod, and the water closing valve is opened; and when the main motor stops working, the micro motor operates reversely, the transmission connecting rod is not stressed, and the water closing valve is closed under the action of the torsion spring.

Specifically, a tooth row 1201 arranged up and down is provided on a side wall of a top end of the transmission connecting rod 12, an output shaft of the micro motor 11 extends horizontally and is connected to a gear 13, and the gear 13 is engaged with the tooth row 1201. Effects: the transmission connecting rod is driven to move up and down through the engagement effect between the gear and the tooth row.

Specifically, the micro motor 11 and the transmission connecting rod 12 are disposed in the cleaning machine body 1. Effect: the micro motor and the transmission connecting rod are disposed in the cleaning machine body to better cooperate with the thimble.

Specifically, the main motor 4 and the main control board 6 are disposed in the cleaning machine body 1. Effects: the main motor and the main control board can be protected in the cleaning machine body.

In actual work: under the control of the main control board, the main motor and the micro motor cooperate, the micro motor employs the gear to drive the transmission connecting rod to move downwards, and the transmission connecting rod drives the thimble of the wastewater tank to transmit power to the valve support of the wastewater tank, so that the water closing valve of the wastewater tank is opened, and the wastewater enters the wastewater tank. Under the control of the main control board, when the main motor stops working, the micro motor employs the gear to drive the transmission connecting rod to move upwards, and the valve support of the wastewater tank is not stressed, so that the water closing valve is closed under the action of the torsion spring so as to achieve the purpose of water closing for the wastewater tank.

In conclusion, the present disclosure has the beneficial effect that the wastewater in the wastewater tank is controllable and is always stored in the wastewater tank. No matter what state the cleaning machine body is in, the wastewater in the wastewater tank does not flow out, and does not cause secondary pollution. Because the micro motor is cooperated with the main motor, the water closing valve of the wastewater tank is opened only when the main motor is working. After the main motor stops working, the water closing valve of the wastewater tank is closed to achieve the effect that the wastewater does not flow out in any state.

The descriptions above are preferred implementations of the present disclosure. It should be noted that for a person of ordinary skill in the art, various improvements and modifications can be made without departing from the principles of the present disclosure. These improvements and modifications should also be regarded as falling into the protection scope of the present disclosure.

The invention claimed is:

1. A device structure for automatically opening and closing a wastewater tank valve of a cleaning machine, comprising a cleaning machine body (1), wherein a water-air separation chamber (2) is provided at a top of the cleaning machine body (1), a sewage tank (3) is detachably mounted at a bottom of the cleaning machine body (1), one end of the water-air separation chamber (2) is connected to a water drawing pipe and the other end of the water-air separation chamber (2) is connected to a main motor (4) having a suction function, a drain port (201) is provided at a bottom end of the water-air separation chamber (2), a wastewater tank inlet (301) is provided at a top end of the wastewater tank (3), and the drain port (201) is communicated with the wastewater tank inlet (301); and the wastewater tank inlet (301) is cooperated with a water closing valve (5), the water closing valve (5) is connected to a drive device which is capable of driving the water closing valve (5) to open and close the wastewater tank inlet (301), the drive device is connected to a main control board (6) with wires, and the main motor (4) is connected to the main control board (6) with wires.

2. The device structure for automatically opening and closing a wastewater tank valve of a cleaning machine according to claim 1, wherein a rotating shaft (7) extending forwards and backwards is provided in the wastewater tank (3), the rotating shaft (7) is disposed at a lower right side of the wastewater tank inlet (301), the rotating shaft (7) is movably connected to one end of a valve support (8), and the other end of the valve support (8) is connected to the water closing valve (5); and the drive device is connected to the valve support (8) and is capable of driving the other end of the valve support (8) connected to the water closing valve (5) to swing up and down around the rotating shaft (7), such that the water closing valve (5) is capable of moving upwards to block the wastewater tank inlet (301) or moving downwards to separate from the wastewater tank inlet (301).

3. The device structure for automatically opening and closing a wastewater tank valve of a cleaning machine according to claim 2, wherein the drive device comprises a drive device body and a torsion spring (9), the torsion spring (9) is disposed on the rotating shaft (7) and is capable of driving the other end of the valve support (8) connected to the water closing valve (5) to automatically swing up around the rotating shaft (7), such that the water closing valve (5) is capable of moving upwards to block the wastewater tank inlet (301); and alternatively, the drive device body is connected to the main control board (6) with wires and is capable of driving the other end of the valve support (8) connected to the water closing valve (5) to swing down, such that the water closing valve (5) is capable of moving downwards to separate from the wastewater tank inlet (301).

4. The device structure for automatically opening and closing a wastewater tank valve of a cleaning machine according to claim 3, wherein a through hole (302) is further provided in the top end of the wastewater tank (3), the through hole (302) is disposed at a right side of the wastewater tank inlet (301) and located above the valve support (8), and a thimble (10) capable of moving up and down is provided in the through hole (302); and a bottom end of the thimble (10) downwards abuts against the valve support (8), the thimble (10) is disposed between the water closing valve (5) and the rotating shaft (7), and the drive device body is disposed above the through hole (302) and is capable of driving the thimble (10) to move downwards.

5. The device structure for automatically opening and closing a wastewater tank valve of a cleaning machine according to claim 4, wherein an arc-shaped portion (1001) is provided on the bottom end of the thimble (10), and a face-up arc-shaped surface (801) is provided on a middle of the valve support (8), which is in sliding fit with the arc-shaped portion (1001).

6. The device structure for automatically opening and closing a wastewater tank valve of a cleaning machine according to claim 5, wherein a width of the arc-shaped portion (1001) is greater than an inner diameter of the through hole (302).

7. The device structure for automatically opening and closing a wastewater tank valve of a cleaning machine according to claim 6, wherein the drive device body comprises a micro motor (11) and a transmission connecting rod (12), the transmission connecting rod (12) is disposed above the thimble (10), the micro motor (11) is connected to the main control board (6) with wires, the micro motor (11) is capable of driving the transmission connecting rod (12) to move up and down, and the transmission connecting rod (12) is capable of driving the thimble (10) to move downwards.

8. The device structure for automatically opening and closing a wastewater tank valve of a cleaning machine according to claim 6, wherein the main motor (4) and the main control board (6) are disposed in the cleaning machine body (1).

9. The device structure for automatically opening and closing a wastewater tank valve of a cleaning machine according to claim 5, wherein the drive device body comprises a micro motor (11) and a transmission connecting rod (12), the transmission connecting rod (12) is disposed above the thimble (10), the micro motor (11) is connected to the main control board (6) with wires, the micro motor (11) is capable of driving the transmission connecting rod (12) to move up and down, and the transmission connecting rod (12) is capable of driving the thimble (10) to move downwards.

10. The device structure for automatically opening and closing a wastewater tank valve of a cleaning machine according to claim 5, wherein the main motor (4) and the main control board (6) are disposed in the cleaning machine body (1).

11. The device structure for automatically opening and closing a wastewater tank valve of a cleaning machine according to claim 4, wherein the drive device body comprises a micro motor (11) and a transmission connecting rod (12), the transmission connecting rod (12) is disposed above the thimble (10), the micro motor (11) is connected to the main control board (6) with wires, the micro motor (11) is capable of driving the transmission connecting rod (12) to move up and down, and the transmission connecting rod (12) is capable of driving the thimble (10) to move downwards.

12. The device structure for automatically opening and closing a wastewater tank valve of a cleaning machine according to claim 11, wherein a tooth row (1201) arranged up and down is provided on a side wall of a top end of the transmission connecting rod (12), an output shaft of the micro motor (11) extends horizontally and is connected to a gear (13), and the gear (13) is engaged with the tooth row (1201).

13. The device structure for automatically opening and closing a wastewater tank valve of a cleaning machine according to claim 12, wherein the micro motor (11) and the transmission connecting rod (12) are disposed in the cleaning machine body (1).

14. The device structure for automatically opening and closing a wastewater tank valve of a cleaning machine according to claim 13, wherein the main motor (4) and the main control board (6) are disposed in the cleaning machine body (1).

15. The device structure for automatically opening and closing a wastewater tank valve of a cleaning machine according to claim 12, wherein the main motor (4) and the main control board (6) are disposed in the cleaning machine body (1).

16. The device structure for automatically opening and closing a wastewater tank valve of a cleaning machine according to claim 4, wherein the main motor (4) and the main control board (6) are disposed in the cleaning machine body (1).

17. The device structure for automatically opening and closing a wastewater tank valve of a cleaning machine according to claim 3, wherein the main motor (4) and the main control board (6) are disposed in the cleaning machine body (1).

18. The device structure for automatically opening and closing a wastewater tank valve of a cleaning machine according to claim 2, wherein the main motor (4) and the main control board (6) are disposed in the cleaning machine body (1).

19. The device structure for automatically opening and closing a wastewater tank valve of a cleaning machine according to claim 1, wherein the main motor (4) and the main control board (6) are disposed in the cleaning machine body (1).

* * * * *